US009136594B2

(12) United States Patent
Shi et al.

(10) Patent No.: US 9,136,594 B2
(45) Date of Patent: Sep. 15, 2015

(54) COMPACT MULTI-BAND PLANAR INVERTED F ANTENNA

(75) Inventors: Guining Shi, San Diego, CA (US); Allen M. Tran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 694 days.

(21) Appl. No.: 12/619,558

(22) Filed: Nov. 16, 2009

(65) Prior Publication Data

US 2011/0043408 A1 Feb. 24, 2011

Related U.S. Application Data

(60) Provisional application No. 61/235,636, filed on Aug. 20, 2009.

(51) Int. Cl.
*H01Q 1/38* (2006.01)
*H01Q 1/48* (2006.01)
*H01Q 9/04* (2006.01)

(52) U.S. Cl.
CPC ..... *H01Q 1/48* (2013.01); *H01Q 9/0421* (2013.01)

(58) Field of Classification Search
CPC ..... H01Q 1/243; H01Q 1/38; H01Q 9/42; H01Q 21/30; H01Q 9/40; H01Q 5/0041; H01Q 7/00; H01Q 5/0034; H01Q 5/0037; H01Q 5/0051; H01Q 9/0421; H01Q 1/48
See application file for complete search history.

(56) References Cited

U.S. PATENT DOCUMENTS 6,339,400 B1 1/2002 Flint et al.
6,343,208 B1 1/2002 Ying
6,414,643 B2 7/2002 Cheng et al.
7,352,326 B2 * 4/2008 Korva et al. ..... 343/700 MS
7,439,922 B2 * 10/2008 Autti ..... 343/702
7,564,413 B2 * 7/2009 Kim et al. ..... 343/702
7,719,470 B2 * 5/2010 Wang et al. ..... 343/700 MS
7,868,831 B2 * 1/2011 Hung et al. ..... 343/700 MS (Continued)

FOREIGN PATENT DOCUMENTS

CN 2588560 Y 11/2003
CN 2600926 Y 1/2004

(Continued)

OTHER PUBLICATIONS

Boyle et al., "A Five-Band Reconfigurable PIFA for Mobile Phones," IEEE Transactions on Antennas and Propagation, vol. 55, No. 11, Nov. 2001, pp. 3300-3309.

(Continued)

*Primary Examiner* — Trinh Dinh
(74) *Attorney, Agent, or Firm* — James Gutierrez

(57) ABSTRACT

A simple, compact multi-band PIFA including two arm portions, where one arm portion is grounded at two points to form a loop, a ground plane, and a plastic carrier and housing. The antenna radiates a same signal from both arm portions, at different efficiencies according to the radiated frequency and the effective length of each arm. The antenna is made from a single standard metal sheet by cutting it and is assembled with the metal ground plane and the other plastic parts. In one embodiment, the antenna is folded into a 3D U-shape to reduce its size for use in mobile communication devices. In another embodiment, the antenna is a penta-band antenna with return loss of −6 B or better and measures 40×8×8 mm or smaller.

9 Claims, 8 Drawing Sheets

(56) References Cited

U.S. PATENT DOCUMENTS

| | | | | |
|---|---|---|---|---|
| 7,911,405 | B2 * | 3/2011 | Pascolini et al. | 343/806 |
| 8,081,120 | B2 * | 12/2011 | Yoshioka | 343/700 MS |
| 8,111,195 | B2 * | 2/2012 | Hung et al. | 343/700 MS |
| 8,164,524 | B2 * | 4/2012 | Tang et al. | 343/700 MS |
| 8,193,993 | B2 * | 6/2012 | Maddaleno | 343/702 |
| 8,587,484 | B2 * | 11/2013 | Peng et al. | 343/700 MS |
| 2002/0021250 | A1 | 2/2002 | Asano et al. | |
| 2004/0070537 | A1 * | 4/2004 | Kadambi et al. | 343/700 MS |
| 2004/0090374 | A1 | 5/2004 | Kuo Dai et al. | |
| 2005/0259024 | A1 | 11/2005 | Hung et al. | |
| 2007/0040747 | A1 | 2/2007 | Kinezos | |
| 2007/0139270 | A1 | 6/2007 | Takei et al. | |
| 2007/0146212 | A1 * | 6/2007 | Ozden et al. | 343/702 |
| 2007/0236391 | A1 * | 10/2007 | Ryou et al. | 343/700 MS |
| 2007/0247372 | A1 | 10/2007 | Huang | |
| 2008/0094303 | A1 | 4/2008 | Tseng et al. | |
| 2008/0143631 | A1 | 6/2008 | Autti | |
| 2009/0009401 | A1 | 1/2009 | Suzuki et al. | |
| 2009/0015497 | A1 | 1/2009 | Nagumo et al. | |
| 2009/0213015 | A1 * | 8/2009 | Boyle | 343/702 |
| 2009/0231213 | A1 | 9/2009 | Ishimiya | |
| 2009/0237311 | A1 * | 9/2009 | Wu et al. | 343/702 |
| 2009/0256763 | A1 * | 10/2009 | Chi et al. | 343/741 |
| 2010/0066628 | A1 * | 3/2010 | Ishimiya | 343/804 |
| 2010/0141536 | A1 * | 6/2010 | Zhang et al. | 343/702 |
| 2010/0214181 | A1 * | 8/2010 | Ryou et al. | 343/702 |
| 2010/0289709 | A1 * | 11/2010 | Guan | 343/702 |

FOREIGN PATENT DOCUMENTS

| | | | | |
|---|---|---|---|---|
| CN | 2706885 | Y | 6/2005 | |
| CN | 1716697 | A | 1/2006 | |
| CN | 2757347 | Y | 2/2006 | |
| CN | 1875518 | A | 12/2006 | |
| CN | 1918920 | A | 2/2007 | |
| CN | 101208825 | A | 6/2008 | |
| CN | 201156582 | Y | 11/2008 | |
| CN | 101345341 | A | 1/2009 | |
| EP | 1923951 | A1 | 5/2008 | |
| EP | 2028720 | A1 | 2/2009 | |
| JP | 2004096314 | A | 3/2004 | |
| JP | 2004208202 | A | 7/2004 | |
| JP | 2006504328 | A | 2/2006 | |
| JP | 2007123982 | A | 5/2007 | |
| JP | 2009033742 | A | 2/2009 | |
| JP | 2009088839 | A | 4/2009 | |
| JP | 2009171528 | A | 7/2009 | |
| WO | 2004038858 | A1 | 5/2004 | |
| WO | 2005048404 | A1 | 5/2005 | |
| WO | WO2005043674 | A1 | 5/2005 | |
| WO | 2007000483 | A1 | 1/2007 | |
| WO | WO2008056159 | A1 | 5/2008 | |
| WO | 2008/136587 | * | 11/2008 | H01Q 9/04 |

OTHER PUBLICATIONS

Boyle et al., "A Low SAR, Five-Band MEMS Switched PIFA For Mobile Phones," Antennas and Propagation Society International Symposium, 2007 IEEE, ISBN: 978-1-4244-0877-1, pp. 2833-2836.

Calvo et al., "Design and Optimization of a Pentaband Terminal Antenna," 18th International Conference on Applied Electromagnetics and Communications, 2005. ICECom 2005, Lab. d'Electromagnetisme et d'Acoustique, Ecole Polytech. Fed. de Lausanne, ISBN: 953-6037-44-0, 4 pages.

Cetiner et al., "Penta-Band Planar Inverted F-Antenna (PIFA) Integrated by RF-NEMS Switches," 17th Biennial University/Government/Industry Micro/Nano Symposium, 2008. UGIM 2008, Electr. & Comput. Eng. Dept., Utah State Univ., Logan, UT, ISBN: 978-1-4244-2484-9, pp. 116-119.

Chang et al., "Printed ?/8-PIFA for Penta-Band WWAN Operation in the Mobile Phone," IEEE Transactions on Antennas and Propagation, Dept. of Electr. Eng., Nat. Sun Yat-Sen Univ., Kaohsiung , May 2009, pp. 1373-1381.

Choi et al., "Compact Surface-mount Wideband and Multi-band Internal Chip Antenna for Mobile Handset," PIERS Online, vol. 3, No. 7, 2007, Hanyang University, Korea, pp. 1044-1047.

Han et al., Compact Five Band Internal Antenna for Mobile Phone, Antennas and Propagation Society International Symposium 2006, IEEE, ISBN: 1-4244-0123-2, pp. 4381-4384.

International Search Report and Written Opinion—PCT/US2010/046230, International Search Authority—European Patent Office—Jan. 21, 2011.

Rhyu et al., "Multi-band hybrid antenna for ultra-thin mobile phone applications," Electronics Letters, Institution of Engineering and Technology, Dept. of Wireless Commun. Eng., Kwangwoon Univ., Seoul, South Korea, vol. 45, Issue 15, Jul. 16, 2009, ISSN: 0013-5194, 2 pages.

Skrivervik et al., "Miniature Antenna Design At Lema," 19th International Conference on Applied Electromagnetics and Communications, 2007, ICECom 2007, ISBN: 978-953-6037-50-6, 4 pages.

Tang et al., "Compact Five Band Meandered PIFA by Using Meandered Slots Structure," Antennas and Propagation Society International Symposium, 2007 IEEE, ISBN: 978-1-4244-0877-1, pp. 653-656.

Wu et al., "Ultra-Wideband PIFA with a Capacitive Feed for Penta-Band Operation in the Folder-Type Mobile Phone," IEEE Antennas and Propagation Society International Symposium, 2008. AP-S 2008, Dept. of Electr. Eng., Nat. Sun Yat-Sen Univ., Kaohsiung, 4 pages.

Yildirim et al., "Reconfigurable Planar Inverted-F Antenna for Mobile Phones," IEEE Antennas and Propagation Society International Symposium, 2007, Fatih Univ., Istanbul, ISBN: 978-1-4244-0877-1, pp. 5207-5210.

Taga T., "Characteristics and Design Method of Plate Type Inversed-F Antenna," Transactions B of the Institute of Electronics, Information, and Communication Engineers, vol. J71-B, No. 11, Nov. 1988, pp. 1399.

* cited by examiner

COMPACT MULTI-BAND PLANAR INVERTED F ANTENNA

CLAIM OF PRIORITY UNDER 35 U.S.C. §119

The present application for patent claims priority to Provisional Application No. 61/235,636, entitled "DUAL GROUNDING PLANAR INVERTED F ANTENNA TYPE ANTENNA" filed Aug. 20, 2009, and assigned to the assignee hereof and hereby expressly incorporated by reference herein.

TECHNICAL FIELD

The present disclosure relates generally to radio frequency (RF) antenna, and more specifically to multi-band Planar Inverted F Antennas (PIFAs).

BACKGROUND

Wireless mobile devices such as cellular phones are getting smaller and in the mean time the number of antennas needed in a device is getting greater. For instance, a typical modern mobile phone has both primary and diversity antennas for enhanced overall WWAN performance. Also, WLAN, Bluetooth, GPS and TV broadcasting (e.g. MediaFlo) all require antennas. Consequently, a typical device may require as many as eight or more antennas in a single device. Multi-band antenna can be used to substantially reduce the antenna count. Optimizing an antenna design so as to keep antenna count low and antenna size small is very challenging. In general, small volume degrades antenna performance while multiple antennas in proximity increase mutual coupling.

Common approaches to the design of multi-band antennas for use in mobile devices include two-dimensional (2D) and three-dimensional (3D) antenna structures of various geometries, the latter being, in many cases, manufactured simply by folding the 2D designs in 3D for decreasing their dimensions. This approach increases the profile dimension of the 3D antenna, which is then determined by the RF coverage of the antenna, the resulting clearance to the ground-reference structure and the dielectric loading effect.

Other efforts used to design compact multi-band antennas include the use of complex electro-mechanical switches (MEMS) to alter antenna geometry and match characteristics to the required RF bands. However, despite good performance, such approaches suffer from the need for matching circuits, increased complexity and cost of manufacture.

An alternative solution involves double grounding planes. Again, the improved performance comes at the penalty of suitability for clam-type mobile devices where the two ground planes can be easily implemented and integrated in the two separate parts of the clam-phone, with their adjoining hinge serving to accommodate the main part of the antenna. This approach still leaves the problem of finding a suitable antenna to support the multi-band need of the more common single-block smart phones.

Preferred approaches include planar inverted F antenna (PIFA) structures. These are the most popular for use in (non-clam-type) mobile phones due to their low profiles. However, conventional PIFA designs only support two or three RF bands. More recent designs can support four and some even five RF bands, the latter commonly referred to as penta-band. For acquiring wide bandwidth, as well as, multi-band properties in PIFA, several multi-resonance techniques using stacked patches, additional parasitic resonators, multi slots, harmonic resonances of meander line, and a slot between feed and shorting pins have been used.

Such antenna configurations unfortunately all suffer from drawbacks. For example, typical multi-band, and particularly, penta-band, PIFA designs are typically too bulky and unsuitable for small devices. Often dimensions are too large, awkward for desired clearances for activation keys and buttons in the appropriate positions, and/or do not provide clearance for easy integration of additional mechanical elements.

There is a need for a multi-band antenna with improved radiation efficiency across as many as five RF bands, having compact dimensions, suitable for use in a common type of mobile device, and easy and cheap to manufacture. The required antenna should fulfill all these needs for a −5 db or −6 db return loss as opposed to existing designs where there is a compromise in one or more requirements.

Figure 1:
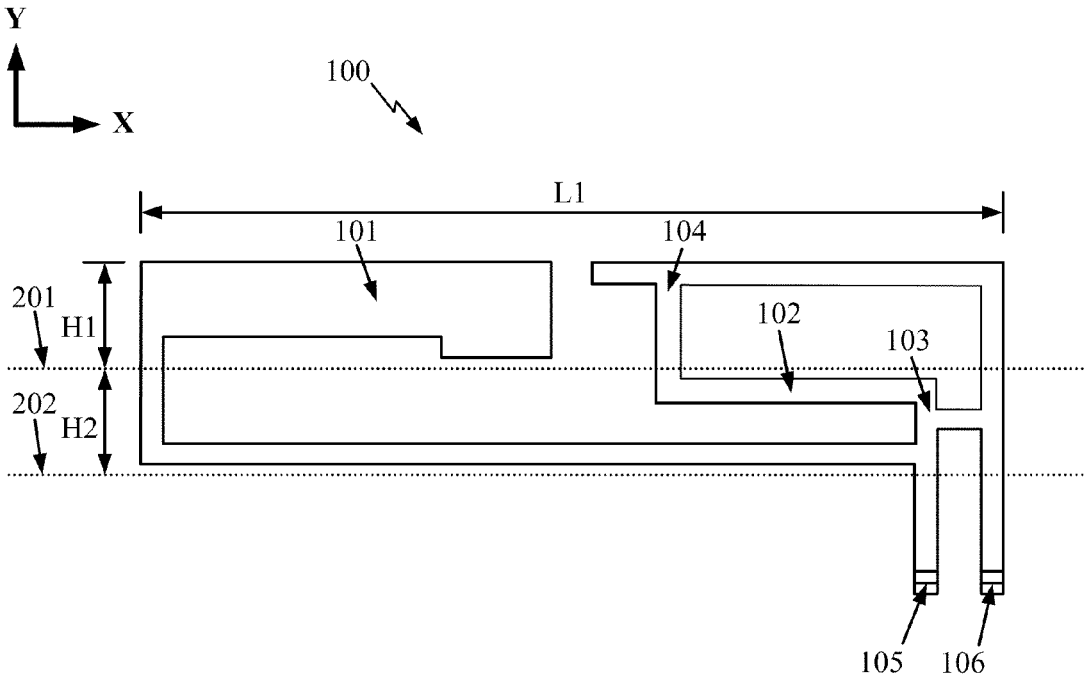
FIG. 1 shows a 2D drawing of a multi-band PIFA for use in mobile communication devices in accordance with an exemplary embodiment.

To facilitate understanding, identical reference numerals have been used where possible to designate identical elements that are common to the figures, except that suffixes may be added, where appropriate, to differentiate such elements. The images in the drawings are simplified for illustrative purposes and are not necessarily depicted to scale.

The appended drawings illustrate exemplary configurations of the disclosure and, as such, should not be considered as limiting the scope of the disclosure that may admit to other equally effective configurations. Correspondingly, it has been contemplated that features of some configurations may be beneficially incorporated in other configurations without further recitation.

DETAILED DESCRIPTION

The word "exemplary" is used herein to mean "serving as an example, instance, or illustration." Any embodiment described herein as "exemplary" is not necessarily to be construed as preferred or advantageous over other embodiments.

The detailed description set forth below in connection with the appended drawings is intended as a description of exemplary embodiments of the present invention and is not intended to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, well known structures and devices are shown in schematic form with no additional detail in order to avoid obscuring the novelty of the exemplary embodiments presented herein.

The present disclosure describes a compact multi-band planar inverted F antenna (PIFA) device with dual grounding structure. This PIFA device can be used in mobile multi-band wireless devices and interfaces for GSM, 3G, OFDM and other types of common air interfaces. More interfaces can be supported by alternative embodiments of the dual-grounded PIFA.

In an exemplary embodiment, from the perspective of antenna performance, with a relatively small volume, the PIFA device can cover five bands with only a −5 dB return loss. Where a −6 dB return loss requirement is necessary, the same PIFA design can still be used to operate across five bands with only slight band narrowing tradeoff.

The PIFA device may be used without matching circuits and so its implementation is simplified without negative effects on radiation efficiency. From the perspective of implementation, the PIFA device as will be shown can easily conform to common device housing and antenna carrier configurations in phone type device, including smart phones and the like. Finally, the PIFA device is easy and cheap to manufacture due to its simple structure and can be implemented with regular antenna carriers, thus making it is easy to assemble. From the perspective of integration, the PIFA device is mainly made of narrow traces, except for one wide trace in the exemplary embodiment presented herein. The PIFA device does not require significant area on an antenna carrier and, therefore, the carrier's surface is freed up for other mechanical features such as a battery door hook or even an opening for the audio chamber. The available area on the carrier is useful in complex system integrations.

FIG. 1 shows a 2D drawing of a compact multi-band PIFA 100 for use in mobile communication devices in accordance with an exemplary embodiment. For purposes of this disclosure, PIFA 100 is defined by a longer arm portion 101 and a shorter arm portion 102.

Longer arm portion 101 is grounded at one end to grounding location 103. Shorter arm portion 102 is grounded at one end to a first grounding location 103 and at the other end to a second grounding location 104. The exact position of grounding locations 103 and 104 may vary in alternative embodiments. Similarly, other possible shapes can be used for the arm portions of the antenna in alternative embodiments.

PIFA 100 is fed through a (common) feeding structure 105. It is grounded through a single grounding structure 106, which is connected to grounding location 103 and grounding location 104. Shorter arm portion 102, which is grounded at both ends through grounding locations 103 and 104, has the form of a loop.

Both arm portions 101 and 102 radiate a same signal though at different efficiencies due to their different lengths. In this particular embodiment, and at a low RF frequency (892 MHz), longer arm portion 101 is the main radiator, and at the same time the (ring-shaped) shorter arm portion 102 also contributes to the overall radiation of PIFA 100. At a higher frequency (1710 MHz) longer arm portion 101 has an effective length of approximately $\lambda/2$ (from current null to longer arm portion's 101 end), and ring-shaped shorter arm portion 102 has an effective length of approximately $\lambda/4$ (from current null to shorter arm portion's 102 end). Other frequencies and different embodiments result in different effective lengths.

PIFA 100 is made from a single sheet of regular (metal) antenna carrier. The manufacturing process is very simple and requires simply the cutting of the carrier sheet in the shape illustrated in FIG. 1.

Longer arm portion 101 is constructed from thinner and wider traces as shown in the exemplary embodiment of FIG. 1. In this embodiment the wider trace is located along a certain length of a portion of the arm portion, which is at the opposite side to the end that is fed and grounded.

Figure 2:
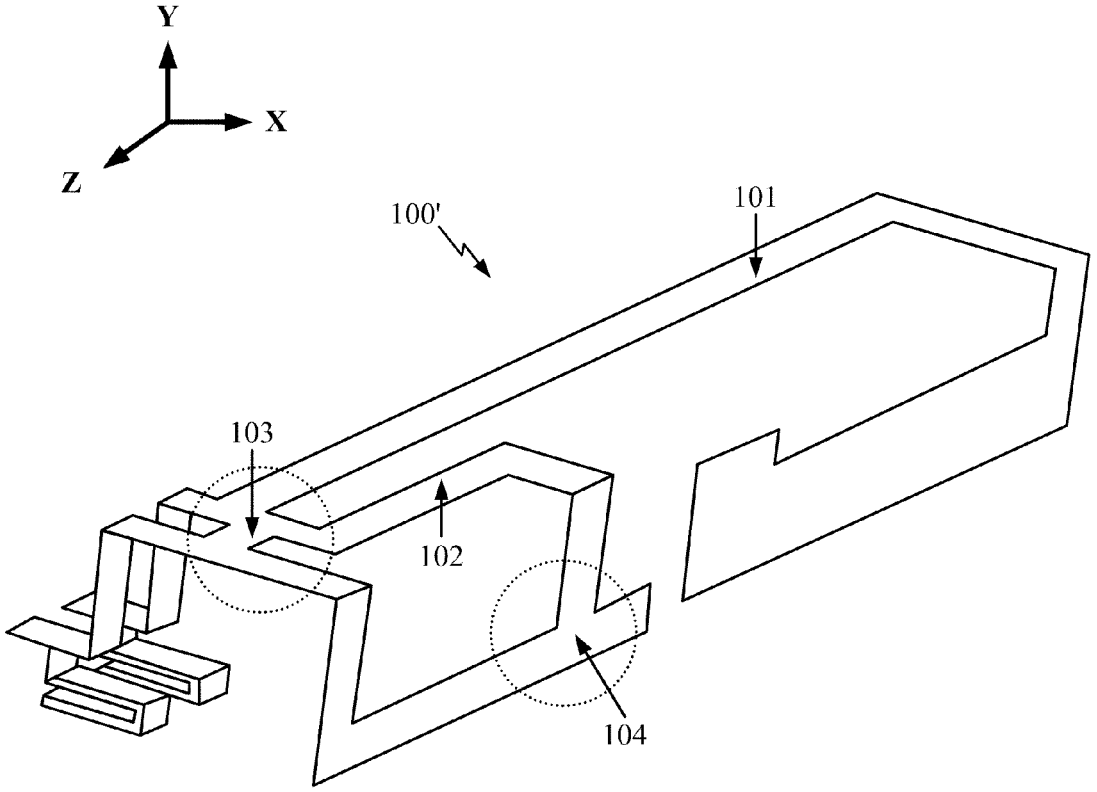
FIG. 2 shows a 3D drawing of an alternative embodiment of the multi-band PIFA of FIG. 1.

The design of the PIFA of FIG. 1 allows the reduction of the size of the antenna's longer and shorter arm portions 101 and 102 by folding them in the XY plane. However, PIFA 100 can be further compacted by folding same into 3 dimensions along dotted lines 201, 202 shown in FIG. 1. The resulting antenna is illustrated in FIG. 2 where the 2D PIFA 100 shown in FIG. 1 is folded into a U shape PIFA 100' in the XY plane. In this exemplary embodiment, PIFA 100' measures 40 mm×8 mm×8 mm corresponding to dimensions represented by L1, H1, and H2 along the XYZ axes as shown in FIG. 1.

Figure 3:
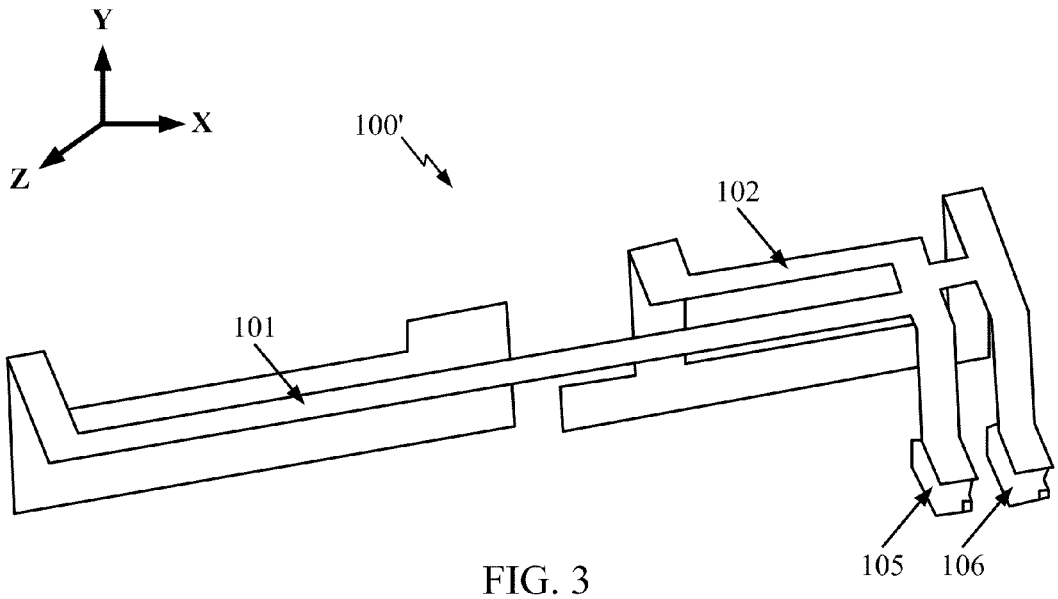
FIG. 3 shows a rotated view of the alternative embodiment of the multi-band PIFA of FIG. 2.

A rotated view of the exemplary embodiment of PIFA 100' of FIG. 2 is shown in FIG. 3. The 3D shape of PIFA 100' elements can be modified in alternative embodiments.

Figure 4:
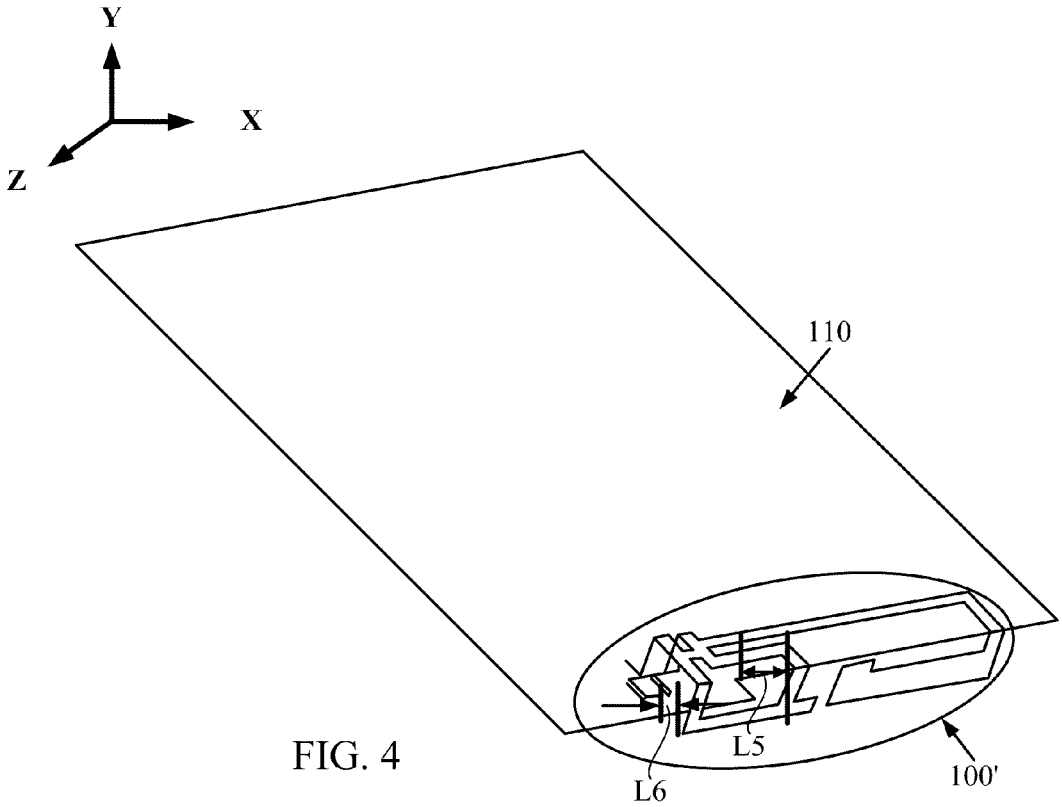
FIG. 4 shows a 3D drawing of the integration of the multi-band PIFA of FIG. 2 and FIG. 3 with a ground plane in accordance with an exemplary embodiment.

PIFA 100' of FIG. 2 and FIG. 3 is mounted on a ground plane 110, as illustrated in FIG. 4, through grounding structure 106. The clearance of PIFA 100' from ground plane 110 is very small, measuring 8 mm along length represented by L5 in general and 4 mm along length represented by L6 in certain areas. It is pointed out that proportions are not in scale and that these clearances can be shortened in alternative implementations.

Figure 5:
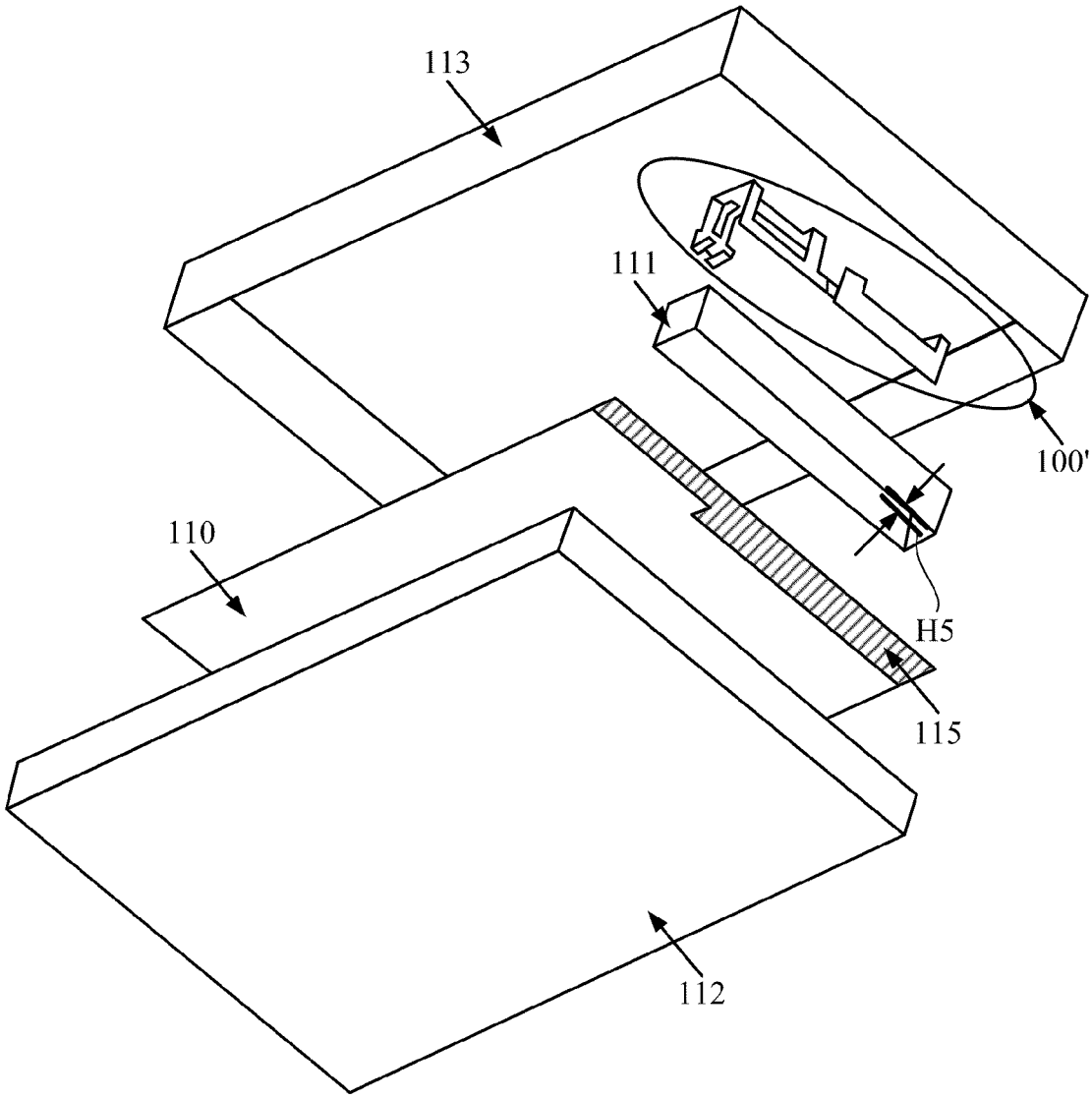
FIG. 5 shows a 3D drawing of an exploded view of the assembly of the multi-band PIFA with ground plane shown in FIG. 4 together with an antenna carrier and housing in accordance with an exemplary embodiment.

FIG. 5 illustrates a 3D drawing of an exploded view of the working environment of antenna 100' of FIG. 2 and FIG. 3. Here is shown PIFA 100', an antenna carrier 111, ground plane 110, and an antenna housing having two parts 112, 113.

Folded PIFA 100' of FIG. 2 and FIG. 3 is placed around antenna carrier 111. Antenna carrier 111 supports PIFA 100' shown in 3D. PIFA 100' is mounted on ground plane 110, above the area 115, which is situated along one of the edges of ground plane 110. PIFA 100' is enclosed by parts 112, 113 of the antenna housing.

Figure 8:
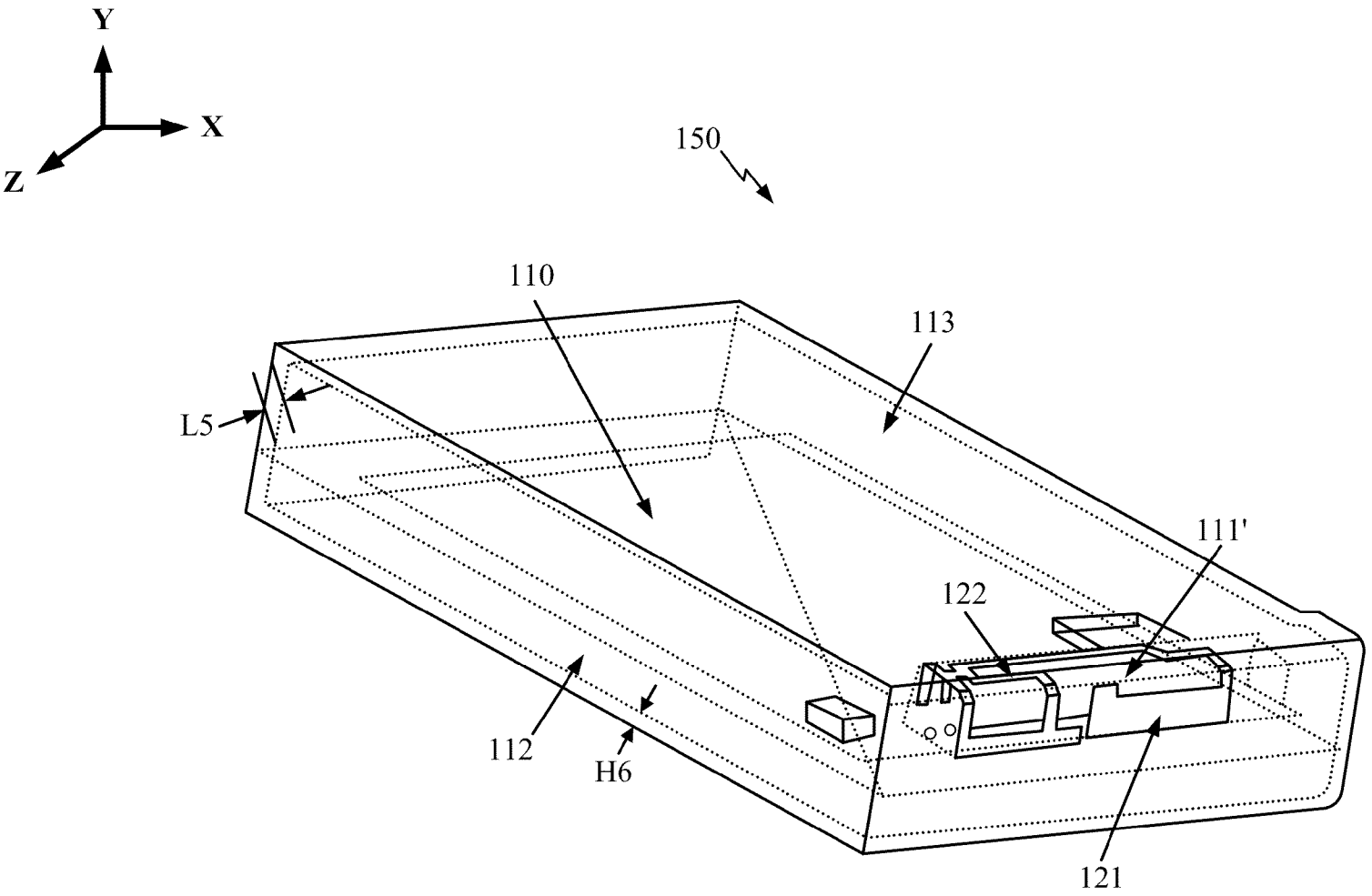
FIG. 8 shows a 3D drawing of the modified multi-band PIFA integrated with the antenna carrier of FIG. 7, the ground plane of FIG. 4, and the antenna housing in accordance with an exemplary embodiment.

In this embodiment, antenna carrier 111 is made of "Noryl 731" plastic ($\in_r$=2.6, tan $\delta$=0.0005 at 2 GHz) and antenna housing parts 112 and 113 are made of Polycarbonate (PC) ($\in_r$=2.9, tan $\delta$=0.0005 at 2 GHz). The wall thickness of antenna carrier 111 is 1 mm and is represented by width H5 as shown in FIG. 5. The wall thickness of antenna housing parts 112 and 113 is 1.5 mm and is represented by width H6 (as shown in FIG. 8). The presence of the antenna carrier 111 and antenna housing parts 112 and 113 helps make PIFA 100' small due to their dielectric loading effect while at the same time providing support and protection to the antenna. Alternative thicknesses and materials can be used in different embodiments of antenna carrier 111 and antenna housing parts 112 and 113 in order to modify their dielectric loading and, combined with different designs for antenna arm portions 101 and 102, can provide improved efficiency and smaller dimensions.

In one exemplary embodiment, antenna carrier 111 is formed into a hollow rectangular box (one side is missing as shown in FIG. 5) to provide clearance to accommodate additional mechanical and/or electrical elements when PIFA 100 is integrated into a mobile communication device.

Referring to FIG. 5, ground plane 110 is made of copper and includes a small area 115. Area 115 is made of FR4.

Figure 6:
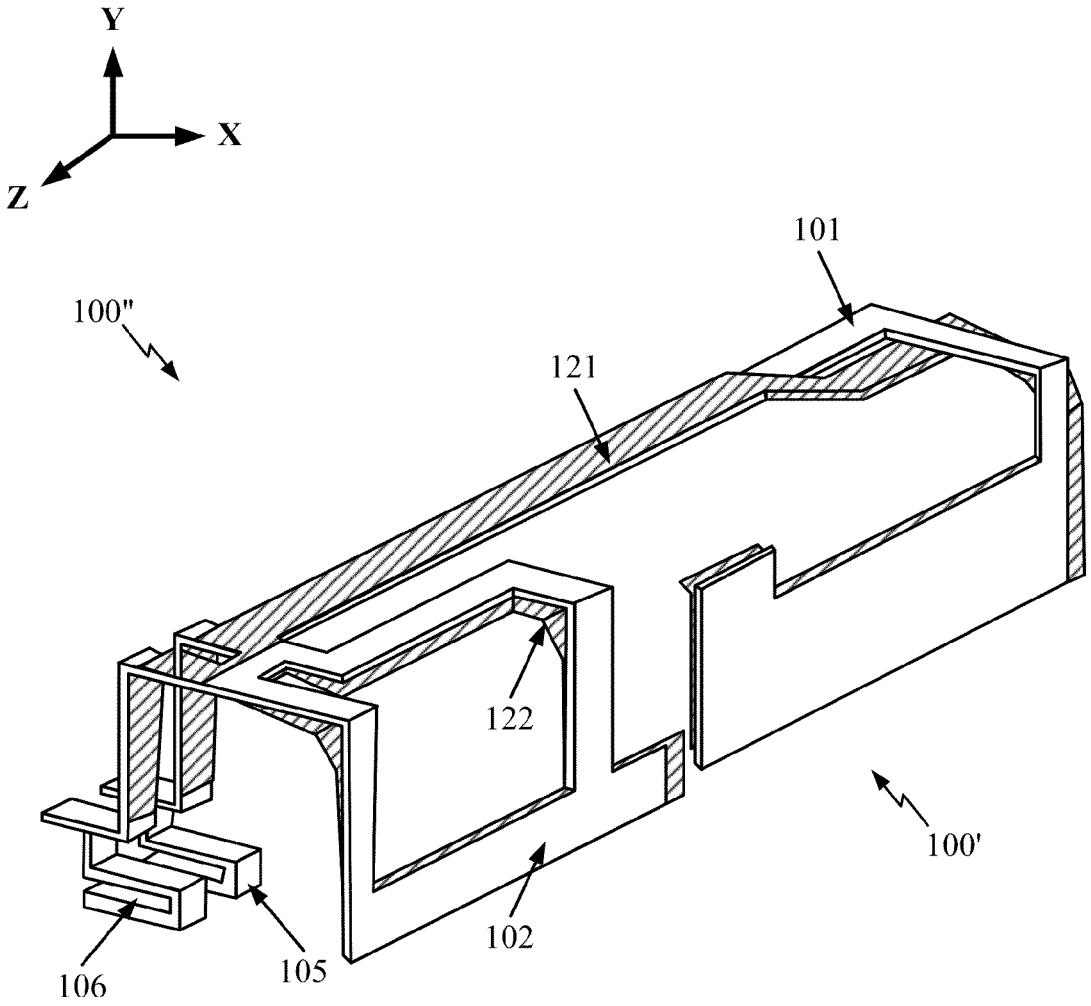
FIG. 6 shows a 3D drawing of the Multi-band PIFA of FIG. 2 and FIG. 3 superimposed on a modified geometry multi-band PIFA in accordance with an exemplary embodiment.

FIG. 6 shows a 3D perspective of a PIFA 100" which is similar to that in FIG. 2 and FIG. 3. PIFA 100" similarly comprises a longer arm portion 121 and a shorter arm portion 122. Feeding structure 105 and grounding structure 106 are the same as with PIFA 100' and represented for this reason by similar numeral designations.

Figure 7:
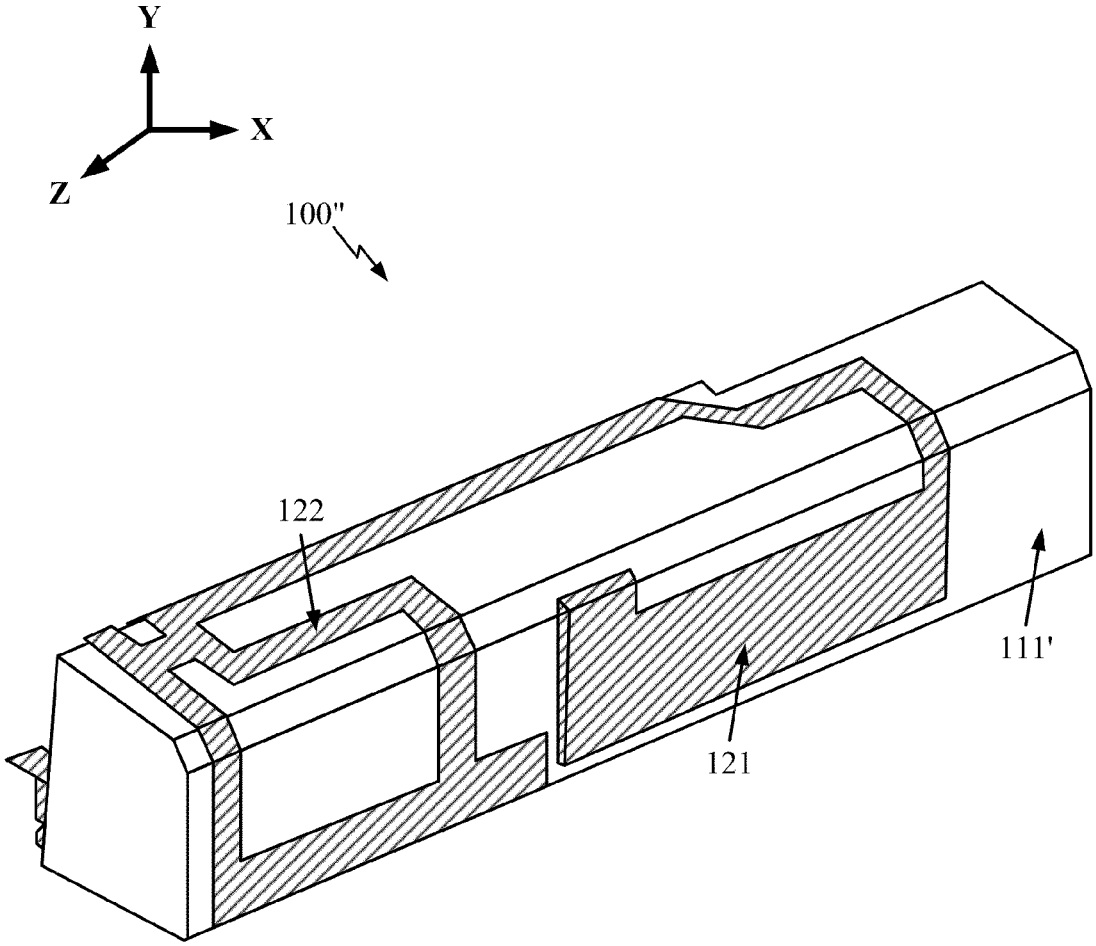
FIG. 7 shows a 3D drawing of the antenna carrier and modified geometry of the multi-band PIFA in accordance with an exemplary embodiment.

FIG. 7 shows PIFA 100" placed on top of an antenna carrier 111'. In this embodiment, antenna carrier 111' is an alternative embodiment of antenna carrier 111 wherein antenna carrier 111 is modified along one edge. Longer and shorter arm portions 121 and 122 are folded in such a way so as to fit along a surface of antenna carrier 111'.

FIG. 8 shows a 3D drawing of PIFA 100" with all the elements of the exploded view of FIG. 5 are mounted and secured in place. The resulting prototype 150 is used in the performance simulation and measurements that are presented below.

Figure 9:
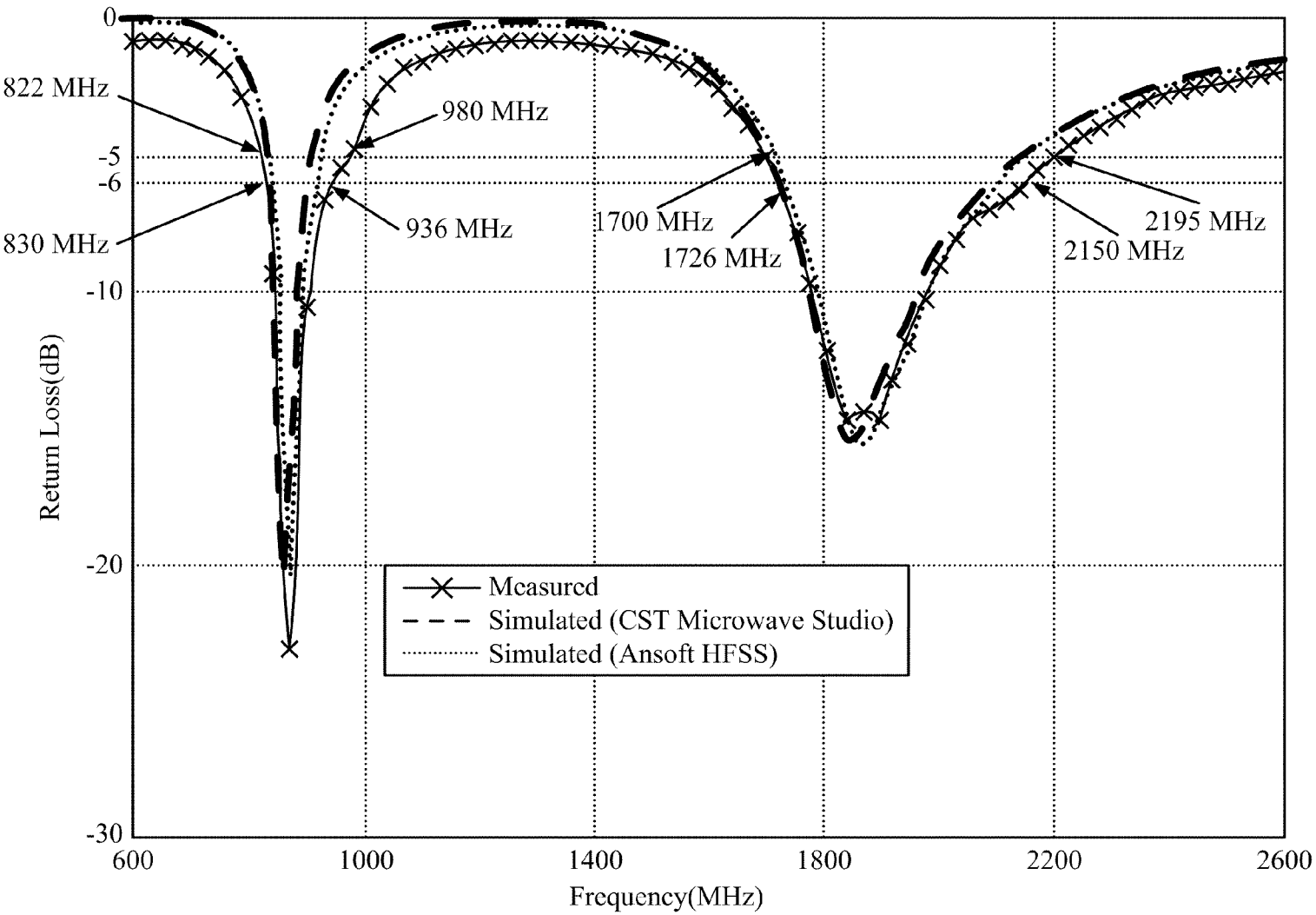
FIG. 9 shows a graph of the multi-band PIFA (of FIG. 8) simulated and measured return loss (600 to 2600 MHz).

FIG. 9 shows a graph of multi-band antenna return loss (0.6 to 2.6 GHz) for the device shown in FIG. 8. The graph shows simulated values obtained using "CTS Microwave Studio" and "Ansoft HFSS", and measured values. PIFA 100" antenna is shown to sufficiently cover five bands (GSM850, GSM 900, GSM1800, GSM1900, 3G) with an acceptable −5 dB return loss at frequencies ranging from 822 to 980 MHz and 1700 to 2196 MHz. With a higher −6 dB return loss constraint, the same antenna is shown to perform in a slightly narrower but acceptable range of frequencies ranging from 830 to 936 MHz and 1726 to 2150 MHz. This performance is achieved without use of matching circuits.

Figure 10:
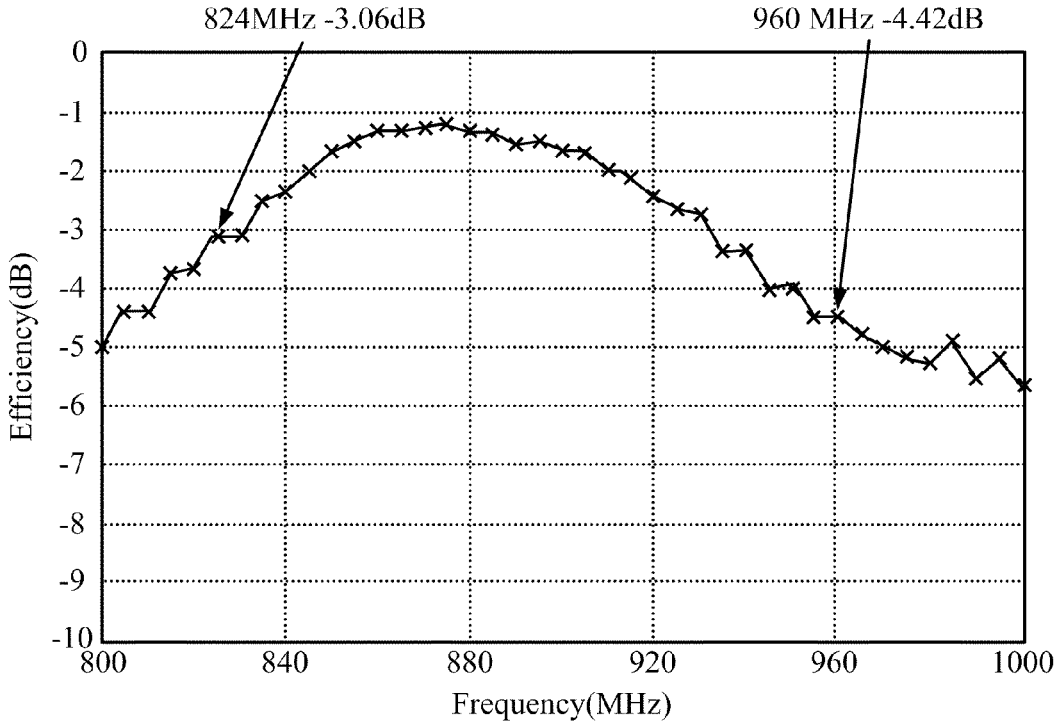
FIG. 10 shows a graph of the multi-band PIFA (of FIG. 8) radiation efficiency (800 to 1000 MHz).

FIG. 10 shows a graph of multi-band antenna radiation efficiency (800 to 1000 MHz) measured in a Satimo chamber for the device shown in FIG. 8. The measured antenna radiation efficiency is shown to be −3.06 dB at 824 MHz (GSM850 uplink) and −4.42 dB at 960 MHz (GSM900 downlink).

Figure 11:
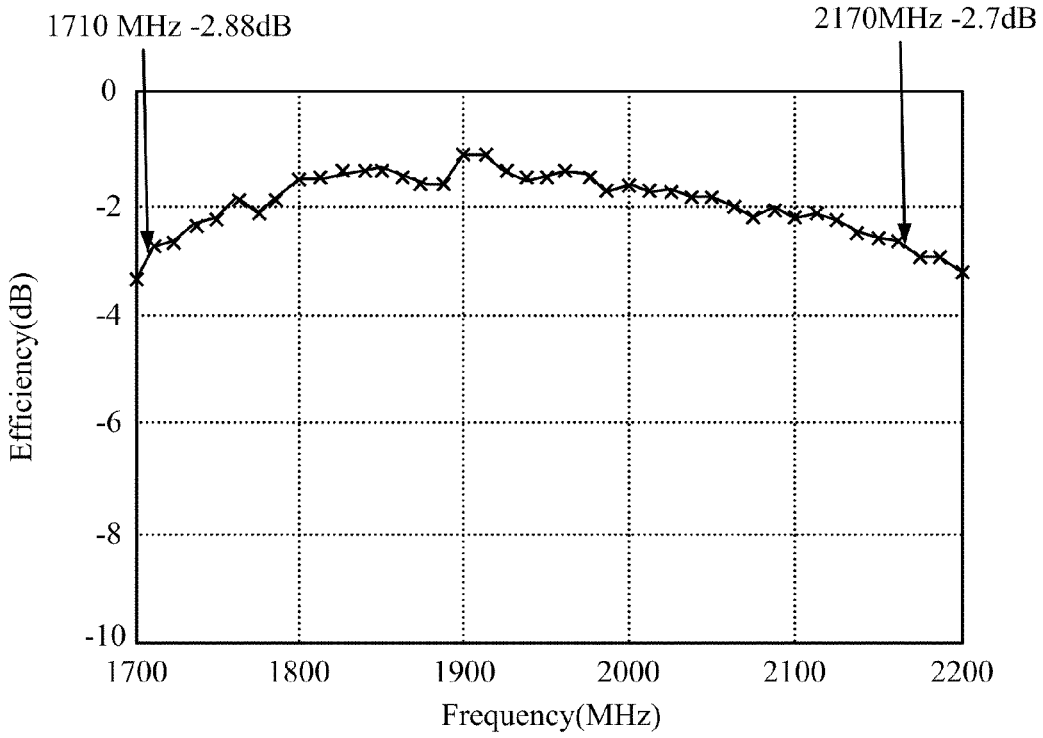
FIG. 11 shows a graph of the multi-band PIFA (of FIG. 8) radiation efficiency (1700 to 2200 MHz).

FIG. 11 shows a graph of multi-band antenna radiation efficiency (1700 to 2200 MHz) measured in a Satimo chamber for the device shown in FIG. 8. The measured antenna radiation efficiency is −2.88 dB at 1710 MHz (DCS1800 uplink) and −2.7 dB at 2170 MHz (UMTS downlink).

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A planar inverted F antenna (PIFA) comprising:

a first arm portion extending in at least two planes, the first arm portion being connected at one end to a first grounding location; and a second arm portion extending in at least two planes;

wherein the first arm portion and the second arm portion are separately coupled at a common feed structure and the second arm portion is connected at one end to the first grounding location and at the other end to a second grounding location, wherein the PIFA radiates a signal at a desired frequency via the first and second arm portions thereof simultaneously, and wherein the first and second grounding locations are connected to a ground plane.

2. The PIFA of claim 1, wherein the first and second grounding locations are connected to a ground plane.

3. The PIFA of claim 1, wherein the antenna is shaped into a folded three-dimensional (3D) U configuration.

4. The PIFA of claim 3, wherein the antenna also includes an antenna support structure.

5. The PIFA of claim 4, wherein one of the longer sides of the antenna support structure is removed to leave a 3D rectangular space for accommodating a plurality of structures that do not form part of the PIFA.

6. The PIFA of claim 3, wherein the PIFA is made of a single metal sheet that is cut and folded.

7. A wireless communication device including a penta-band planar inverted F antenna (PIFA), the penta-band PIFA comprising:

a first arm portion extending in at least two planes, the first arm portion being connected at one end to a first grounding location; and a second arm portion extending in at least two planes, wherein the first arm portion and the second arm portion are separately coupled at a common feed structure and the second arm portion is connected at one end to the first grounding location and at the other end to a second grounding location, wherein the penta-band PIFA radiates a signal at a desired frequency via the first and second arm portions thereof simultaneously, and wherein the first and second grounding locations are connected to a ground plane.

8. The wireless communication device of claim 7, wherein the first and second grounding locations are connected to a ground plane.

9. The wireless communication device of claim 7, wherein the penta-band PIFA is shaped into a folded three-dimensional (3D) U configuration.

* * * * *